United States Patent [19]

Becker et al.

[11] 4,116,728

[45] Sep. 26, 1978

[54] TREATMENT OF AMORPHOUS MAGNETIC ALLOYS TO PRODUCE A WIDE RANGE OF MAGNETIC PROPERTIES

[75] Inventors: Joseph J. Becker; Fred E. Luborsky; Israel S. Jacobs; Richard O. McCary, all of Schenectady, N.Y.

[73] Assignee: General Electric Company, Schenectady, N.Y.

[21] Appl. No.: 719,914

[22] Filed: Sep. 2, 1976

[51] Int. Cl.[2] ..... C21D 1/04

[52] U.S. Cl. ..... 148/108; 148/121; 148/31.55; 336/213

[58] Field of Search ..... 148/108, 121, 31.55; 324/43, 34; 315/248; 336/213; 75/122; 333/30 R

[56] References Cited

U.S. PATENT DOCUMENTS

| | | | |
|---|---|---|---|
| 3,409,475 | 11/1968 | Greenberg et al. | 148/108 |
| 3,614,893 | 10/1971 | Nesbitt et al. | 75/123 K |
| 3,820,040 | 6/1974 | Berry et al. | 148/31.55 |
| 3,838,365 | 9/1974 | Dutoit | 333/30 R |
| 3,856,513 | 12/1974 | Chen et al. | 75/122 |
| 4,036,638 | 7/1977 | Ray et al. | 148/31.55 |

OTHER PUBLICATIONS

Berry, B. et al., *Obtaining a Hard Magnetic Array . . . ;* in *IBM Tech. Disc. Bull.,* 16, Sep. 1973, pp. 1191–1192.

*Primary Examiner*—Arthur J. Steiner
*Attorney, Agent, or Firm*—Lawrence D. Cutter; Joseph T. Cohen; Marvin Snyder

[57] ABSTRACT

Amorphous magnetic metal alloys are processed by annealing at temperatures sufficient to achieve stress relief and cooling in directed magnetic fields or in zero magnetic fields.

The ac and dc properties of magnetic cores produced in accordance with the processes of the invention may be tailored to match those of a wide range of magnetic alloys.

Alloys processed in accordance with the invention provide improved performance in inductors, transformers, magnetometers, and electrodeless lamps.

10 Claims, 14 Drawing Figures

Fig. 1
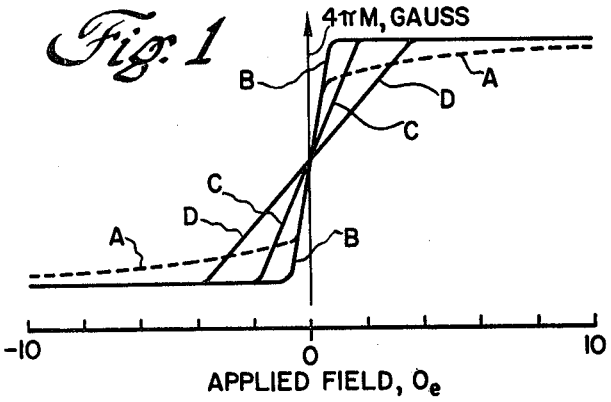
Fig. 7
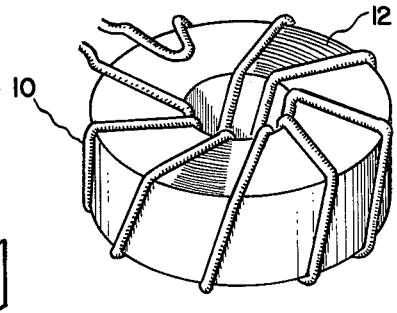
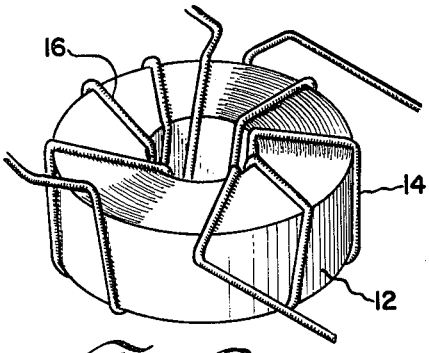
Fig. 8
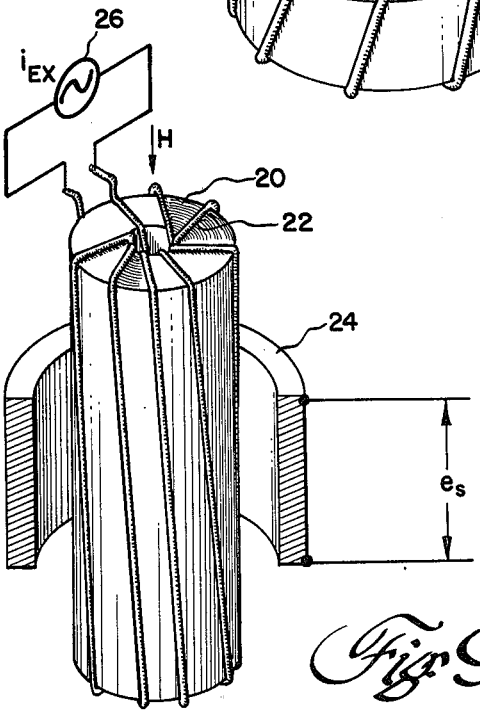
Fig. 9
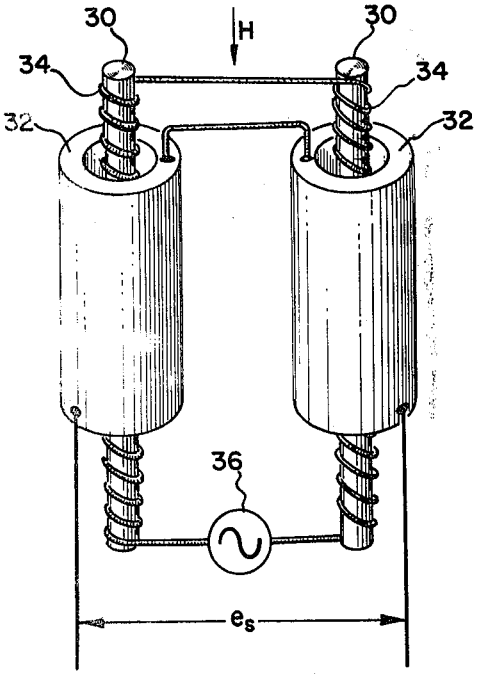
Fig. 10

Fig. 4
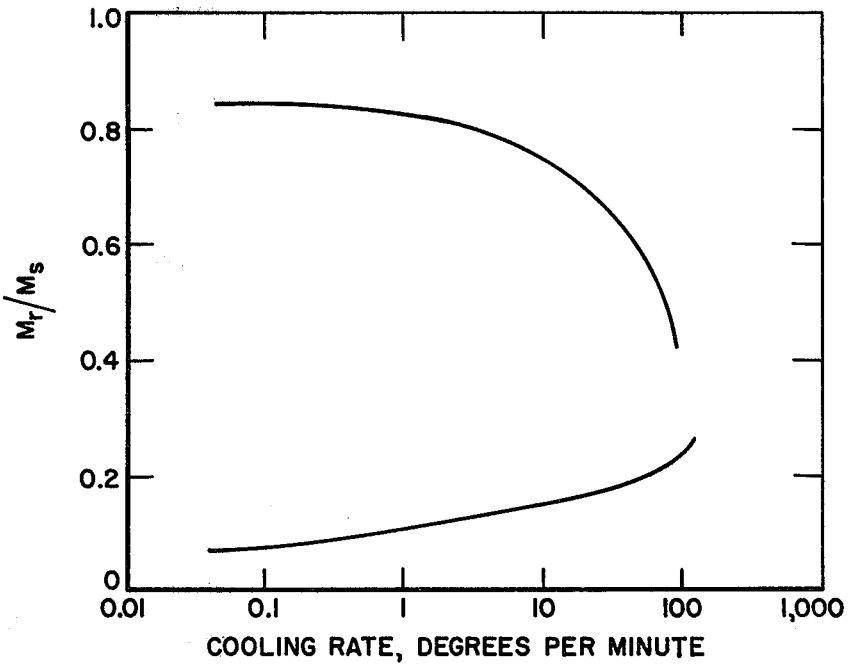
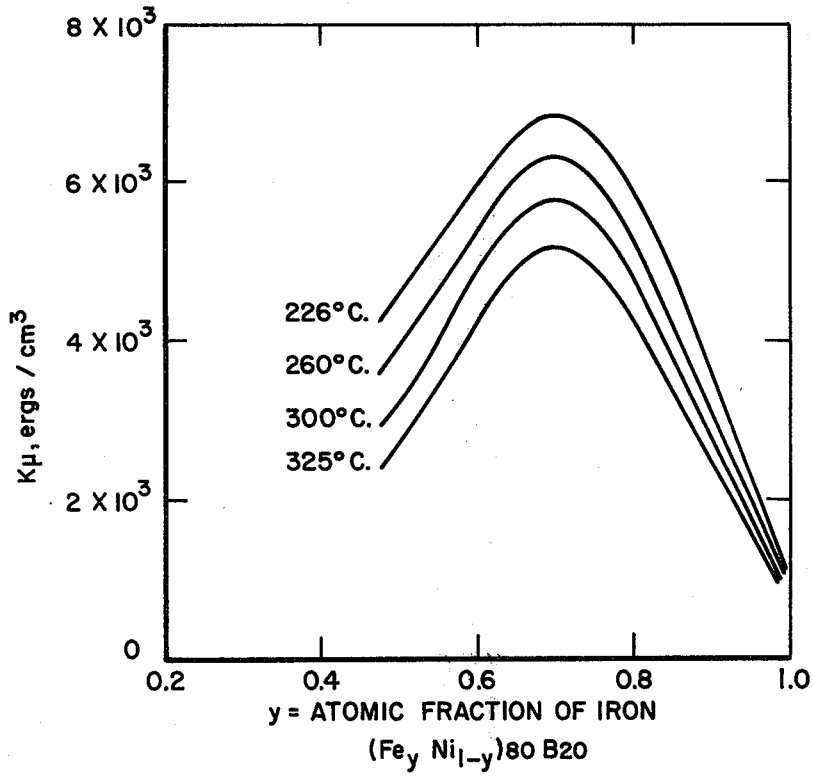
Fig. 2

Fig. 6
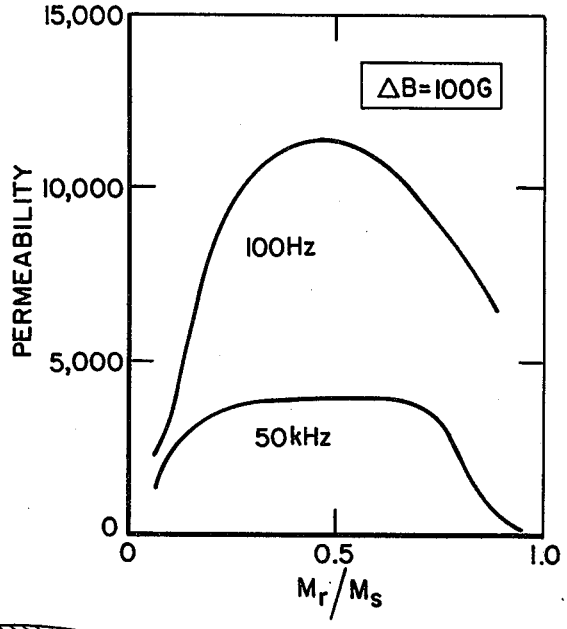
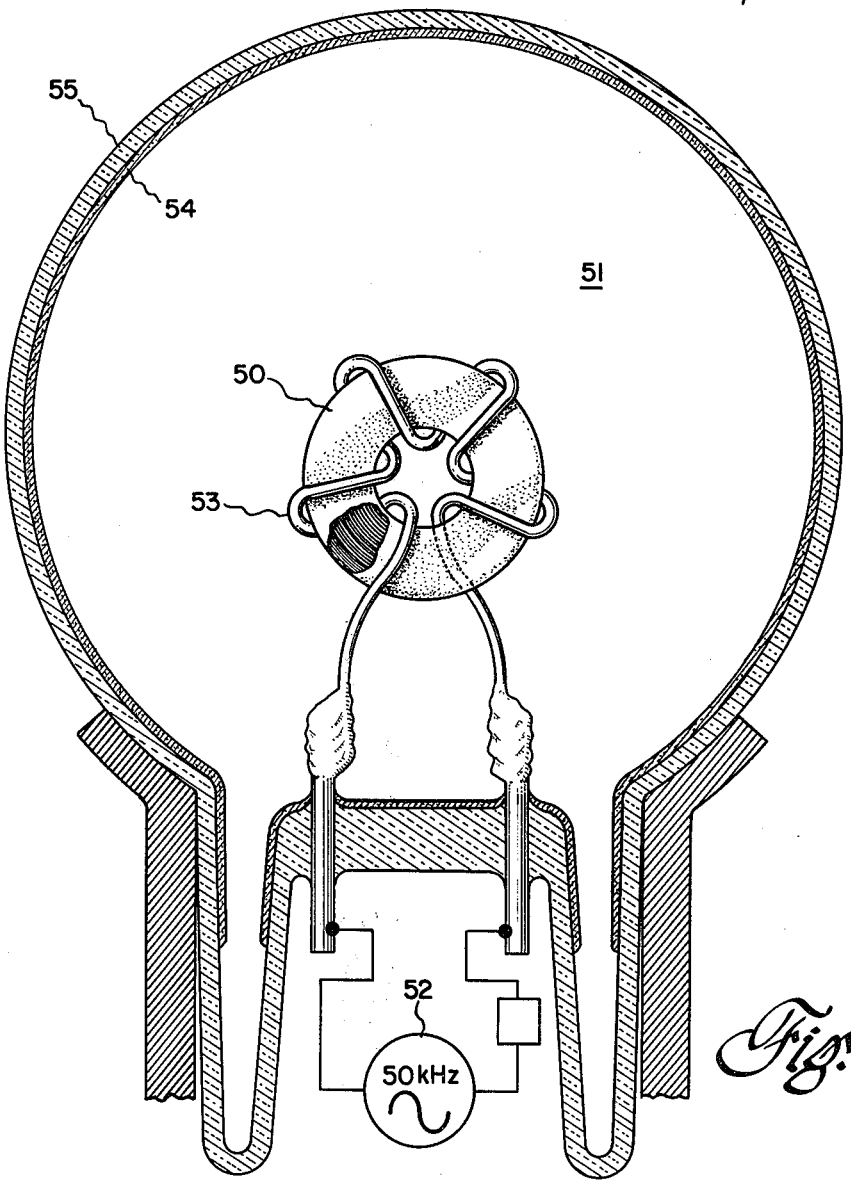
Fig. 11

TREATMENT OF AMORPHOUS MAGNETIC ALLOYS TO PRODUCE A WIDE RANGE OF MAGNETIC PROPERTIES

BACKGROUND OF THE INVENTION

This invention relates to processes for heat-treating amorphous metal alloys and to products produced thereby. More specifically, this invention relates to processes for heat-treating and magnetic annealing amorphous metal alloys to tailor the magnetic properties thereof for specific product applications.

A group of magnetic, amorphous metal alloys have recently become commercially available. These compositions and methods for producing them are described, for example, in U.S. Pat. Nos. 3,856,513 to Chen et al., 3,845,805 to Kavesh, and 3,862,658 to Bedell. Such alloys are presently produced on a commercial scale by the Allied Chemical Corp. and are marketed under the Metglas® trademark.

Amorphous metal alloys have been utilized, for example, as cutting blades, described in U.S. Pat. No. 3,871,836 to Polk et al., and as acoustic delay lines, described in U.S. Pat. No. 3,838,365 to Dutoit.

Berry et al., in U.S. Pat. No. 3,820,040 have described an electromechanical oscillator wherein the Young's modulus of elasticity of an amorphous alloy is varied as a function of applied magnetic field. The Berry patent describes tests in which the Young's modulus and frequency of oscillation of amorphous alloy elements are caused to vary by a process which includes magnetic annealing of amorphous alloys in both parallel and transverse magnetic fields.

The remanence ratio $M_r/M_s$ of a magnetic material is a measure of the shape of its magnetic hysteresis loop and is indicative of the potential usefulness of that material in various magnetic devices. Prior art amorphous magnetic alloys have generally been characterized by a ratio $M_r/M_s$ between approximately 0.4 and approximately 0.6.

It is well known that magnetic annealing may be utilized to control the magnetic properties of certain polycrystalline magnetic alloys; e.g., the Permalloys.

SUMMARY OF THE INVENTION

We have determined that the magnetic properties of amorphous metal alloys may be varied over a wide range by annealing stress-relieved alloys in magnetic fields. Thus, a dc remanence ratio $M_r/M_s$ of approximately 0.9 may be produced by annealing an alloy ribbon through its Curie temperature in a parallel magnetic field. The same sample annealed through its Curie temperature in a transverse magnetic field exhibits a remanence ratio of only 0.03.

Toroids of amorphous magnetic alloys which are annealed in parallel magnetic fields are particularly suited for use as switching cores, high gain magnetic amplifiers, and as transformer or inductor cores in low frequency inverters, where a square loop characteristic is desirable. Elements with low remanence ratios are useful as filter choke cores, loading coil cores, and as elements in flux gate magnetometers.

The magnetic properties of amorphous metal alloys may thus be tailored to approximate the desirable properties of a wide range of other, more expensive magnetic materials.

It is, therefore, an object of this invention to provide new and inexpensive magnetic materials having a wide range of magnetic properties.

Another object of this invention is to provide methods and processes for tailoring and adjusting the magnetic properties of amorphous magnetic alloys.

Another object of this invention is to provide novel, low cost magnetic circuit elements having magnetic properties which may be adjusted over a wide range.

Another object of this invention is to provide magnetic cores for flux gate magnetometers which are characterized by an extremely low value of coercive force.

BRIEF DESCRIPTION OF THE DRAWINGS

The novel features believed to be characteristic of the present invention are set forth in the appended claims. The invention itself, together with further objects and advantages thereof, may best be understood by reference to the following detailed description taken in connection with the appended drawings in which:

FIG. 1 is a family of magnetization curves for an amorphous alloy which are produced by varying the process parameters of a magnetic anneal;

FIG. 2 is a plot of the magnetically induced anisotropy of an amorphous metal alloy as a function of composition for various anneal temperatures for Fe-Ni-B amorphous alloys.

FIG. 4 is a plot of the remanence ratio of an amorphous metal alloy as a function of the cooling rate utilized in a magnetic anneal.

FIG. 6 is a plot of ac permeability as a function of the remanence ratio in an amorphous magnetic alloy;

FIG. 7 is a toroidal inductor of the present invention;

FIG. 8 is a toroidal transformer of the present invention;

FIG. 9 is a magnetometer of the present invention which includes a toroidal magnetic core;

FIG. 10 is a magnetometer of the present invention which includes rod-like magnetic cores;

FIG. 11 is an induction ionized fluorescent lamp comprising an amorphous magnetic alloy core.

DESCRIPTION OF THE PREFERRED EMBODIMENTS

Figure 3:
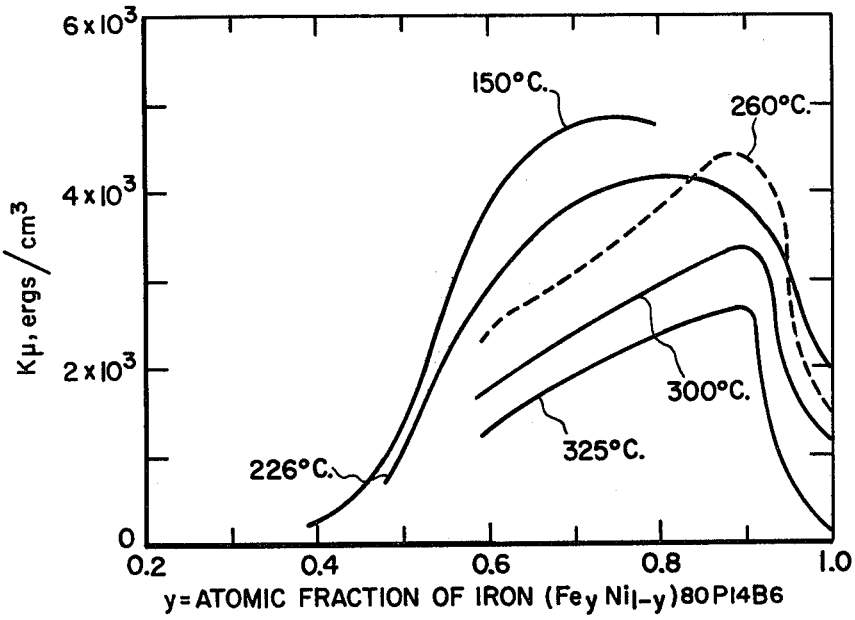
FIG. 3 is a plot of the magnetically induced anisotropy of an amorphous metal alloy as a function of composition for various anneal temperatures for Fe-Ni-P-B amorphous alloys.

Amorphous metal alloys have recently become commercially available in the form of thin ribbons and wires. These metallic glasses are characterized by an absence of grain boundaries and an absence of long range atomic order. They exhibit a number of unusual properties including corrosion resistance, low sonic attenuation, and high strength. The alloys are produced by rapidly quenching molten metals, at a rate of approximately $10^6$ ° C./sec., to develop a glassy structure. Methods and compositions useful in the production of such alloys are described in the above-described U.S. patents which are incorporated herein, by reference, as background material.

In 1971, A. W. Simpson and D. R. Brambley suggested that very low magnetic coercive forces might be possible in amorphous alloys because of the absence of crystalline anisotropy and grain boundaries. Magnetostrictive contributions to the coercive force might also be avoided by suitable choice of alloy compositions. The alloys would then be predicted to have exceedingly high dc initial permeabilities.

Low coercive forces and high permeabilities were confirmed, to some extent, in materials with potentially useful compositions prepared as foils or ribbons. R. C. Sherwood et al., have reported coercive forces of from 0.01 to 0.1 Oe in a $(Ni,Fe,Co)_{0.75}(P,B,Al)_{0.25}$ alloy. Field annealing of a zero magnetostrictive composition reduced the coercive force to 0.013 Oe (*AIP Conference Proceedings,* No. 24, 1975). Others have reported coercive forces as low as 0.007 Oe by annealing nonzero magnetostrictive compositions under elastic stress. These results, together with domain observations, have led us to conclude that, even in the zero magnetostrictive alloys, there still exists an anisotropy which can be influenced by magnetic or stress annealing.

We have determined that ferrous amorphous alloys may be processed by magnetic annealing to develop useful ac permeabilities and losses. It has been predicted that the cost of amorphous ferrous alloys, on a large commercial scale, will be comparable to that of the conventional polycrystalline steels. Such amorphous alloys can be processed in accordance with the methods of the present invention to yield materials having, for example, low loss, high permeability, and square hysteresis loops. Such characteristics are comparable with those of the more expensive nickel-based magnetic alloys, for example, Permalloys, which must typically be produced in ingot form, and then rolled and heat-treated many times to yield useful magnetic devices.

Amorphous alloys are produced by rapidly quenching liquid metal compositions to produce glassy substances directly in the form of thin ribbons which are required for use in devices. The limitations of the quenching process dictate that the presently available amorphous alloys be in the form of thin wires or ribbons.

In accordance with the present invention, ribbons of a ferrous amorphous alloy are heated in a temperature and time cycle which is sufficient to relieve the material of all stresses but which is less than that required to initiate crystallization. The sample may then be either cooled slowly through its Curie temperature, or held at a constant temperature below its Curie temperature in the presence of a magnetic field. The direction of the field during the magnetic anneal may lie in the plane of the ribbon, either parallel or transverse to its length and, by controlling the direction of the field, its strength, and the temperature-time cycle of the anneal, the magnetic properties of the resultant material may be varied to produce a wide range of different and useful characteristics in magnetic circuit elements.

The term "directed magnetic field", as used herein and in the appended claims, includes magnetic fields of zero value and magnetic fields with rapidly changing direction.

The examples set forth below demonstrate the usefulness of the process of the present invention with a variety of ferrous amorphous alloy compositions and configurations. It is to be appreciated, however, that the process is useful with any magnetic amorphous alloy which is characterized by a Curie temperature which is sufficiently high to allow atomic mobility during a magnetic annealing process. For alloys of the type discussed below, a Curie temperature of at least approximately 160° C. is generally sufficient to allow this mobility. The Curie temperature of the alloy may lie below or above its recrystallization temperature.

EXAMPLES OF THE MAGNETIC ANNEALING OF AMORPHOUS ALLOYS

Ten centimeter straight ribbons of METGLAS 2826 amorphous alloy, produced by the Allied Chemical Co. of Morristown, N.J. and having a nominal composition of $Ni_{40}Fe_{40}P_{14}B_6$ were sealed in tubes under vacuum. A field of 21 Oe along the long axis of the ribbon was obtained from a long solenoid in a shielded area of an oven. A residual field of 4000 Oe from a permanent magnet was used for annealing across the width of the ribbon. Temperatures were monitored by a thermocouple placed next to the sample.

Toroidal samples were made by winding approximately fourteen turns of MgO-insulated ribbon in a 1.5 centimeter diameter aluminum cup. Fifty turns of high temperature insulated wire were wound on the toroid to provide a circumferential field of 4.5 Oe for processing. The toroids were sealed in glass tubes under nitrogen. A 120 minute heat treatment was used; both dc and ac properties were determined. The ac permeabilities and losses were obtained using sine wave current driven by conventional techniques at frequencies from 100 Hz to 50 kHz.

EXAMPLE OF THE MAGNETIC ANNEAL OF A STRAIGHT RIBBON

A straight ribbon of METGLAS 2826 alloy was annealed at 290° C. in the presence of a 21 Oe magnetic field. After annealing, the coercive force of the sample was less than 0.003 Oe. This is believed to be the lowest reported coercive force in any potentially useful soft magnetic material. Samples annealed at temperatures in excess of 360° C. exhibited crystalline structures.

EXAMPLES OF MAGNETICALLY INDUCED ANISOTROPY

Ribbons of METGLAS 2826 alloy were annealed for 2 hours at 325°. C. FIG. 1 indicates the magnetization curves produced by cooling these samples in directed magnetic fields. Curve A of FIG. 1 is characteristic of METGLAS 2826 before annealing. Curve B of FIG. 1 is characteristic of a sample which was cooled from 325° C. at a rate of 50 deg/min in a magnetic field parallel to the ribbon length. Curve C of FIG. 1 is characteristic of a sample which was cooled in a magnetic field transverse to the ribbon length at a rate of 50 deg/min. Curve D is characteristic of a sample which was cooled in a magnetic field transverse to the ribbon length at a rate of 0.1 deg/min. From the slopes of these curves, the induced anisotropy $K_u$ may be calculated. The magnitude and direction of $K_u$ determine the remanence-to-saturation ratio and the coercive force of the resultant toroid.

Values of $K_u$ for two series of alloys, $(Fe_yNi_{1-y})_{80}B_{20}$ and $(Fe_yNi_{1-y})_{80}P_{14}B_6$, are shown in FIGS. 2 and 3 as a function of anneal temperature. The values of $K_u$ shown are the equilibrium values attained after exposure for a sufficient time at each temperature to reach equilibrium. Shorter times result in smaller values of $K_u$. The magnitude of $K_u$ is determined by the alloy composition, the anneal temperature, and the anneal time.

EXAMPLE OF ANNEALING OF TOROIDS OF AMORPHOUS ALLOYS

The magnetic properties of amorphous alloys are extremely stress-sensitive. Thus, the properties of amorphous alloy ribbons, which are annealed in straight form, suffer degradation when wound into toroidal magnetic cores. We have determined, however, that amorphous alloy ribbons can also be successfully magnetic-annealed in the form of toroidal samples. When this is done, the magnetic properties are substantially improved over those of toroids wound from annealed straight ribbons. The ac properties of amorphous alloy toroids are particularly improved when the magnetic anneal is conducted in toroidal form. Table I indicates the magnetic properties of toroids formed from METGLAS 2826 ribbon (A) without heat treatment; (B) annealed as straight ribbons and then wound into a toroid form; and (C) annealed as a toroid. The magnetic properties of other common magnetic alloys are included in Table I for comparison purposes.

As indicated in the foregoing discussion, the remanence-to-saturation ratio of amorphous magnetic alloy ribbons may be increased by annealing in a parallel magnetic field or may be decreased by annealing in a transverse magnetic field. The particular value of the remanence-to-saturation ratio produced by the annealing process may be controlled by varying the process parameters of the magnetic anneal.

rate varies from between approximately 0.1° C. per minute to approximately 100° C. per minute.

EXAMPLES OF HEAT-TREATING OTHER AMORPHOUS ALLOY TOROIDS

Table II indicates variations in the magnetic properties of typical magnetic amorphous alloys processed in transverse and parallel magnetic fields in the manner indicated above.

Although the experimental results set forth herein pertain to binary iron-nickel alloy systems, which may include the glass formers, phosphorus and boron, it will be obvious to those skilled in the art that they are equally applicable to amorphous binary systems of iron and cobalt and to tertiary systems of iron, nickel, and cobalt. Likewise, other glass-forming elements, for example, silicon, carbon, and aluminum may be substituted for the phosphorous and/or boron without qualitatively affecting the magnetic annealing properties of the alloys, although they may affect the rate at which annealing occurs and the magnitude of $K_u$. The results are, furthermore, equally applicable to amorphous alloy systems containing the usual and well-known nonmagnetic elements which are typically utilized to modify the magnetic characteristics of alloys, for example, molybdenum, manganese, and chromium.

Figure 5:
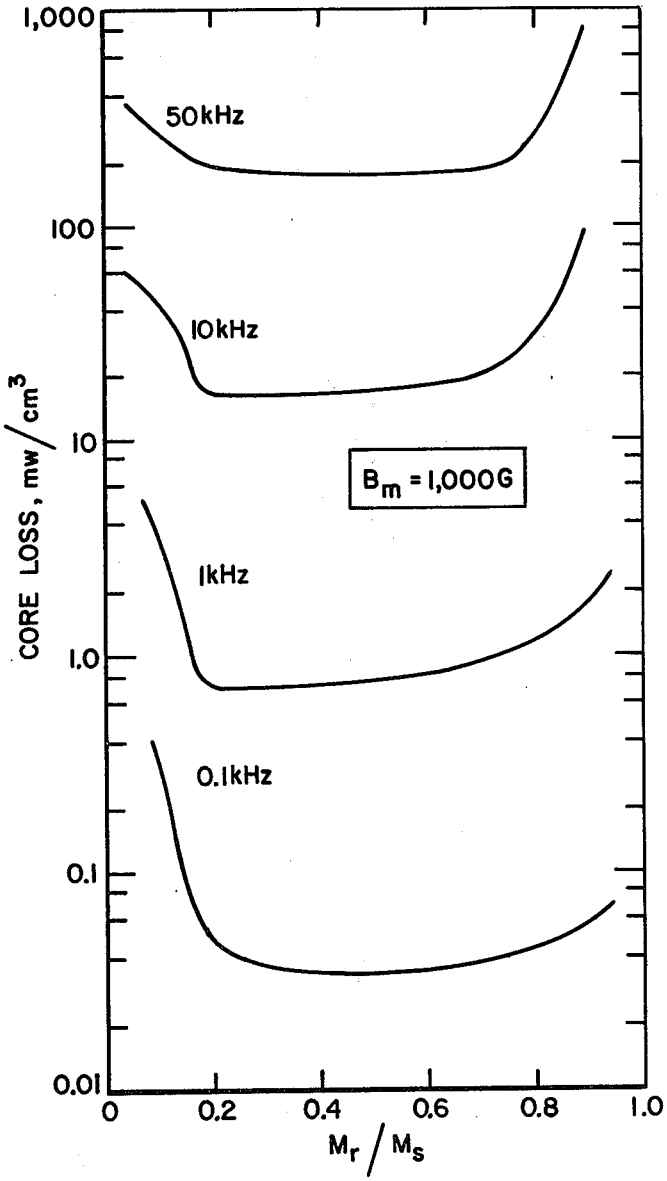
FIG. 5 is a plot of ac losses as a function of the remanence ratio in an amorphous magnetic alloy.

The ac core losses of annealed amorphous magnetic alloy toroids vary as a function of the remanence-to-saturation ratio and are generally lowest for intermediate values of that ratio. FIGS. 5 and 6 are a series of plots of core loss and permeability in a stress-relieved METGLAS 2826 toroid as a function of the remanence-to-saturation ratio of the toroid.

FIG. 4 is a plot of the remanence-to-saturation ratio produced by annealing a toroid of METGLAS 2826 ribbon as a function of the cooling rate utilized during the magnetic anneal. As shown in FIG. 4, the cooling

TABLE I

TYPICAL PROPERTIES OF TOROIDAL AMORPHOUS RIBBON COMPARED TO SOME PERMALLOYS

| | | $B_m$ = 1000 G Core Loss mw/cm³ | | ΔB = 100 G jPermeability | | D.C. Prop's. $H_m$ = 1 Oe | | |
|---|---|---|---|---|---|---|---|---|
| Sample | Treatment | 10 kHz | 50 kHz | 100 Hz | 50 kHz | $H_c$ (Oe) | $4\pi M_r$ (gauss) | $4\pi M_{o.s.}$ (gauss) |
| METGLAS 2826 ($Fe_{40}Ni_{40}P_{14}B_6$) | None | 400 | 3,000 | — | 200 | 0.06 | 3,500 | 3,500 |
| | Annealed as straight ribbon, 1 hr at 280° C, then wound | 200 | 4,000 | 3,000 | 300 | .065 | 3,000 | 3,400 |
| | Annealed as toroid, 2 hr at 325° C, in a field | 18 | 180 | 12,000 | 4,300 | .020 | 5,500 | 6,900 |
| 4–79 Mo-Permalloy | Data from Arnold Catalog TC-101B | 12 | 150 | 35,000 | 3,500 | .025 | — | 7,500 |
| Square Permalloy | Data from Arnold Catalog TC-101B | 9 | 160 | — | — | .028 | — | 7,000 |
| Supermalloy | Data from Arnold Catalog TC-101B | 7.5 | 120 | 65,000 | 4,000 | .005 | — | 7,000 |

0.005 cm thick ribbon
$4\pi M_s$ = 7900 gauss

TABLE II

TYPICAL PROPERTIES OF TOROIDAL RIBBONS OF DIFFERENT AMORPHOUS ALLOYS

| | | $B_m$ = 1 kG Core Loss mw/cm³ | | | | B = 100 G Permeability | | | | |
|---|---|---|---|---|---|---|---|---|---|---|
| Nominal Composition | Treatment | 100 Hz | 1 kHz | 10 kHz | 50 kHz | 100 Hz | 50 kHz | Hc (Oe) | $M_r/M_s$ | $4\pi M_s$ |
| $Fe_{80}B_{20}$ | (1) None | 0.17 | 5.1 | 340 | 990 | 2500 | 360 | 0.13 | 0.63 | 16300 |
| | 2 hrs at 325° C stress relief, then: | | | | | | | | | |
| | (2) 2 hrs at 275° C in 4.5 Oe ‖ H | 0.060 | 1.5 | 45 | 180 | 5800 | 1800 | 0.075 | 0.58 | |
| | (3) 2 hrs at 275° C in 3500 Oe ⊥ H | 0.044 | 1.0 | 30 | 220 | 5500 | 2600 | 0.074 | 0.46 | |
| $Fe_{40}Ni_{40}B_{20}$ | (4) None | 0.18 | 4.3 | 440 | 2200 | 2000 | 260 | 0.10 | 0.61 | 10300 |
| | 2 hrs at 343° C stress relief, then: | | | | | | | | | |
| | (5) cooled in H = 0 | 0.14 | 4.3 | 200 | 580 | 870 | 610 | 0.12 | 0.33 | |
| | (6) 2 hrs at 280° C in 3500 Oe ⊥ H + 25 hrs at 240° C in 4.5 Oe ‖ H | 0.038 | 1.0 | 42 | 540 | 3800 | 1600 | 0.11 | 0.68 | |
| | (7) 2 hrs at 280° C in | 0.004 | 1.2 | 25 | 190 | 2900 | 2300 | 0.15 | 0.15 | |

TABLE II-continued

TYPICAL PROPERTIES OF TOROIDAL RIBBONS OF DIFFERENT AMORPHOUS ALLOYS

| Nominal Composition | Treatment | $B_m$ = 1 kG Core Loss mw/cm³ 100 Hz | 1 kHz | 10 kHz | 50 kHz | B = 100 G Permeability 100 Hz | 50 kHz | Hc (Oe) | $M_r/M_s$ | $4\pi M_s$ |
|---|---|---|---|---|---|---|---|---|---|---|
| | 3500 Oe ⊥ H | | | | | | | | | |

0.0025 cm thick ribbons

Toroids with minimum core loss may be produced by heating to achieve stress relief and subsequent annealing to control the magnetically reduced anisotropy. For example, if the Curie temperature is below the stress relief temperature, quenching the sample from above the Curie temperature will produce an intermediate $M_r/M_s$ and, thus, low core losses.

The process of the present invention allows adjustment of the ac and dc properties of amorphous alloy magnetic cores to provide characteristics suitable for different types of applications.

Samples with high $M_r/M_s$ are particularly suited for devices such as switch cores, high gain magnetic amplifiers, and low frequency inverters where a square loop characteristic is needed. FIG. 7 is an inductor comprising a conductive winding 10 linked around a toroidal core of a spirally wound, amorphous alloy ribbon 12.

FIG. 8 is a transformer comprising a spirally wound, toroidal core of a magnetic amorphous alloy 12 linked with a conductive primary winding 14 and a conductive secondary winding 16. Additional windings may, of course, be wound on the core 12, if desired.

Magnetic cores produced from amorphous alloys which have been treated to achieve low remanence ratios are desirable for applications where constant permeability is desired over a wide range of applied fields. Inductors comprising cores of these materials are useful as filter chokes, loading coils, and as flux gate magnetometers. FIG. 9 is a coaxial flux gate magnetometer comprising a toroidal core of spirally wound amorphous alloy ribbon characterized by a low value of coercive force 20 linked by a primary winding 22. A tubular, secondary sense element 24 is disposed coaxially with the magnetic core 20. An alternating current source 26 produces a primary current through the winding 22 with a symmetrical waveform which drives the core 20 to saturation. In the absence of an applied magnetic field current flow in the primary winding 22 induces a symmetrical output voltage $e_s$ across the secondary 24. If the magnetic field is applied along the axis of the core 20, asymmetry is developed in the output voltage $e_s$ which may be utilized, in a well-known manner, to measure the strength of the applied magnetic field. The operation of flux meters of this type is, of course, well known and is described, for example, in a review article by Gordon and Brown, *Recent Advances in Flux Gate Magnetometry*, IEEE Transactions on Magnetics, Vol. MAG 8, No. 1, 1972, p. 76, which is incorporated herein by reference as background material.

Flux gate magnetometers may also be produced using solid, rod-like cores of amorphous magnetic wire or spirally wound tape. FIG. 10 is a dual core flux gate magnetometer which comprises two rod-like amorphous alloy cores 30 disposed centrally within series-connected, conductive sense elements 32. Primary windings 34 are helically wrapped around the cores 30 and are driven from a current source 36 in a manner described in the above-referenced review article.

High permeability, toroidal cores have recently been utilized to couple electrical energy into induction ionized gas discharge lamps. FIG. 11 is such a lamp comprising a toroidal core 50 disposed centrally within an ionizable gaseous medium 51 and driven by a radio frequency current source 52 through a primary winding 53. Current flow in the primary induces an electric discharge in the gaseous medium which produces visible light by ultraviolet stimulation of a phosphor 54 on the inner surface of a substantially globular, light transmissive glass envelope 55, in a well-known manner. The construction and operation of such lamps is described, for example, in patent application Ser. No. 642,142 to John M. Anderson now issued U.S. Pat. No. 4,017,764, which is assigned to the assignee of this invention and which is incorporated, by reference, herein as background material. The operation of ferrite cores in such lamps is, however, at times, limited by core losses and by the magnetic characteristics of ferrite wherein the permeability and the saturation flux density decrease substantially at elevated temperatures.

Figure 12:
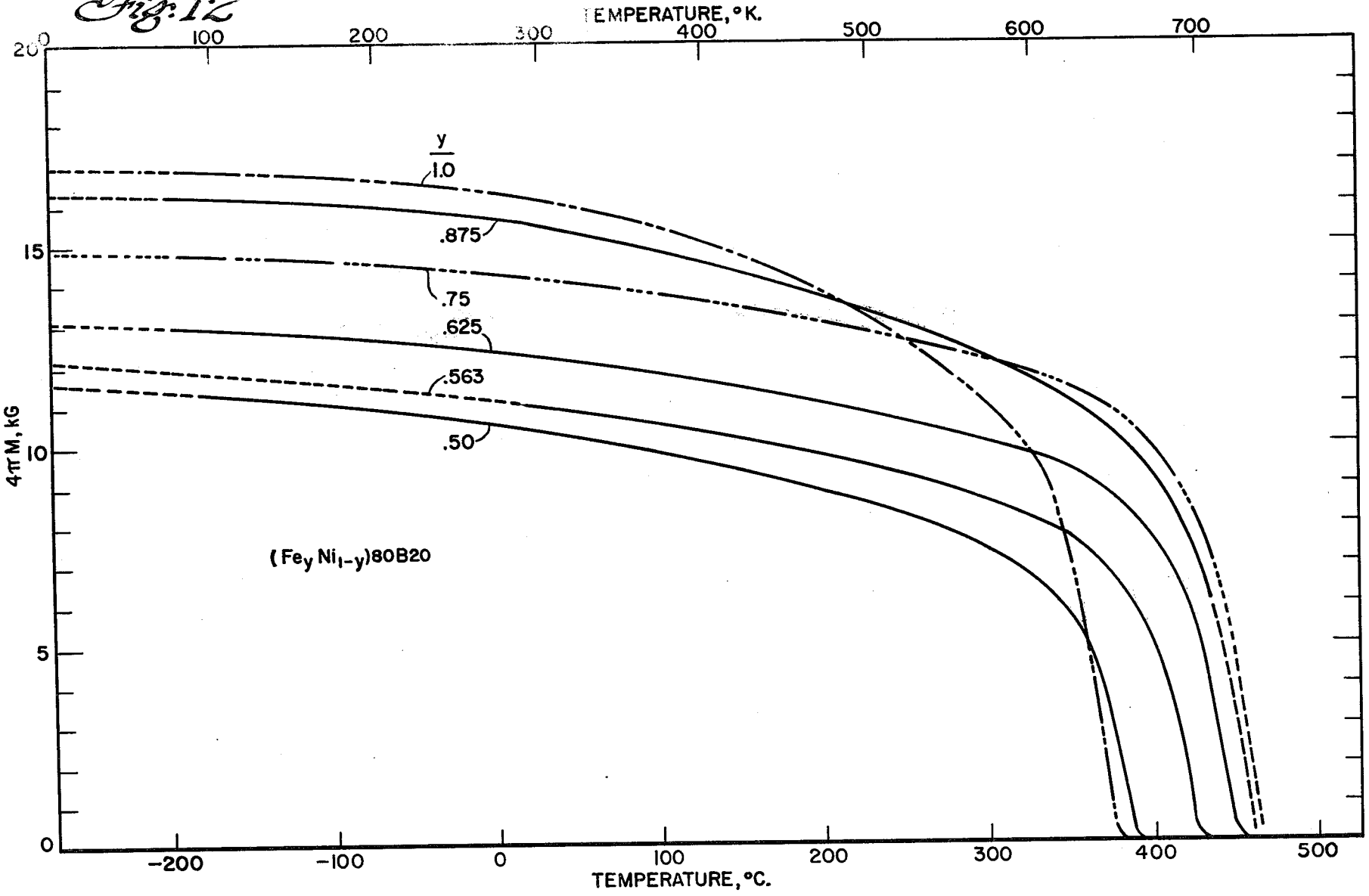
FIGS. 12, 13, and 14 are plots of saturation flux density, permeability, and core losses as a function of the temperature of an amorphous alloy toroid.
Figure 13:
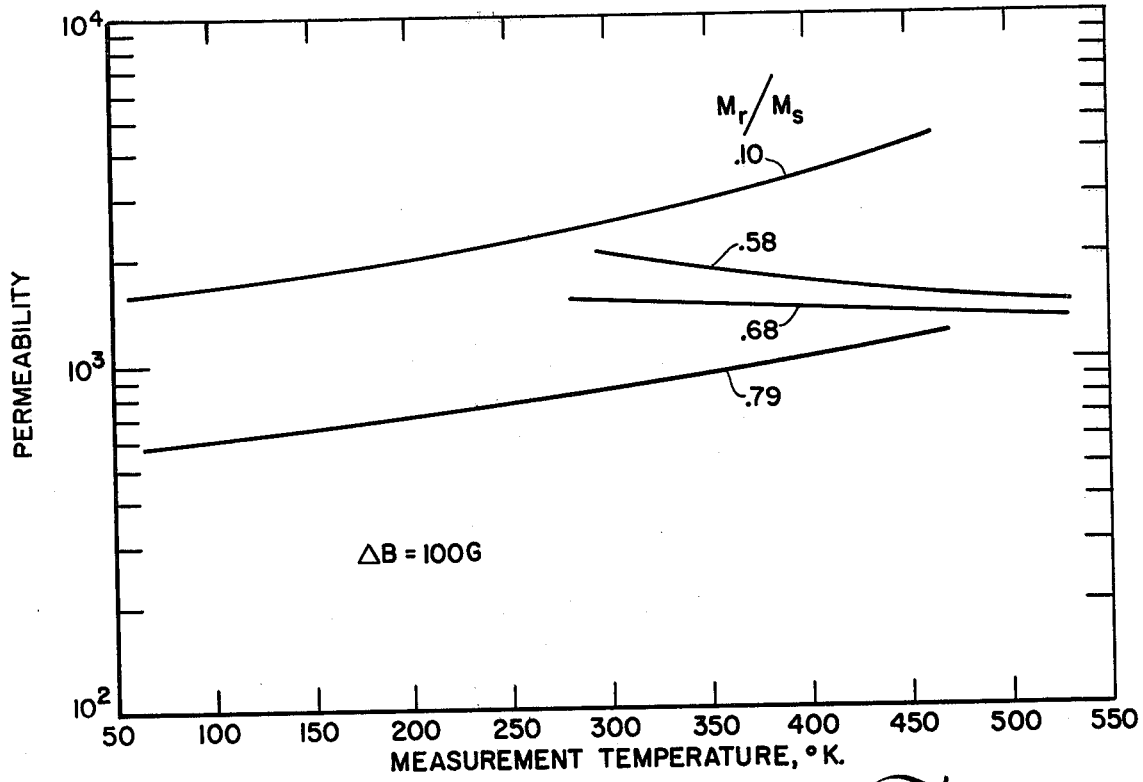
Figure 14:
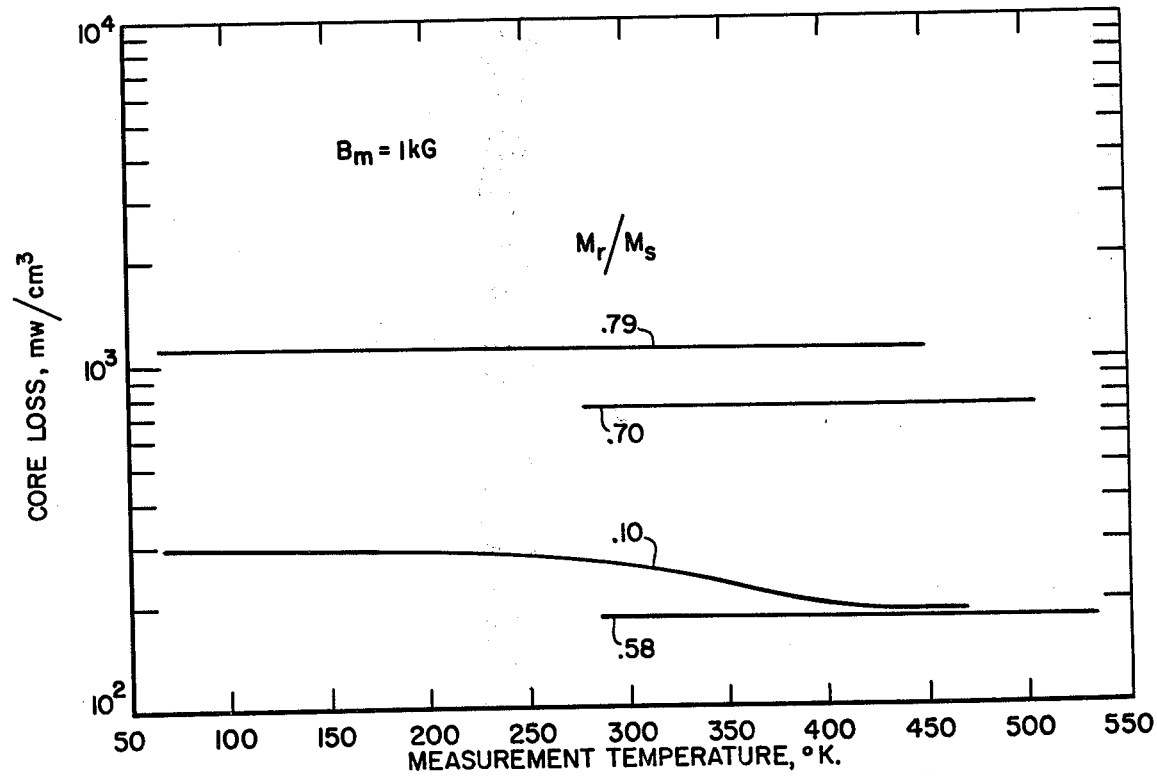

We have determined that although ac losses at room temperature in lamp toroids of amorphous alloy ribbon are somewhat higher than those in the best available ferrites, the saturation flux density of amorphous alloy cores is substantially greater and maintains this value at substantially higher temperatures than the ferrites. Furthermore, the losses and permeability of the amorphous alloys are independent of operating temperature in contrast to the ferrites. FIG. 12 illustrates the variation of saturation flux density with temperature while FIGS. 13 and 14 illustrate the variation of losses and permeability with temperature for toroidal cores produced from the indicated amorphous alloys in accordance with the methods of the present invention.

Improved induction ionized fluorescent lamps containing toroidal cores of amorphous magnetic alloys, in place of conventional ferrite cores, are, therefore, capable of more efficient high temperature operation than are prior art lamps.

Amorphous alloys processed in accordance with the methods of the present invention thus provide low cost, high performance substitutes for magnetic circuit elements which comprised prior art, polycrystalline, magnetic materials.

While the invention has been described in detail herein in accord with certain preferred embodiments, many modifications and changes therein may be effected by those skilled in the art. Accordingly, it is intended by the appended claims to cover all such modifications and changes as fall within the true spirit and scope of the invention.

The invention claimed is:

1. A method for processing magnetic amorphous alloys to control the shape of the hysteresis loop of said alloys, said method comprising the steps of:

heating an amorphous magnetic alloy to a temperature sufficient to achieve stress relief but less than that required to initiate crystallization; and then controllably cooling said alloy in the presence of a magnetic field, the rate of cooling being between approximately 0.1° C. per minute and approximately 100° C. per minute whereby magnetic amorphous alloys are usable in a greater variety of magnetic circuit applications.

2. The method of claim 1 wherein said amorphous magnetic alloy is disposed as a ribbon and wherein said magnetic field is directed parallel to the length of said ribbon.

3. The method of claim 1 wherein said amorphous magnetic alloy is disposed as a ribbon and wherein said magnetic field is directed in the plane of said ribbon and transverse to its length.

4. The method of claim 1 wherein said magnetic alloy comprises iron and materials selected from the group consisting of nickel, cobalt, and mixtures thereof.

5. The method of claim 4 wherein said amorphous alloy comprises a binary system of iron and nickel.

6. The method of claim 4 wherein said amorphous alloy comprises $Fe_{40}Ni_{40}P_{14}B_6$.

7. The method of claim 1 wherein said heating step comprises heating said alloy above its Curie temperature but below the temperature required to initiate crystallization and wherein said cooling step comprises cooling said alloy through its Curie temperatue in the presence of a magnetic field.

8. A method for adjusting the magnetic properties of a magnetic amorphous alloy comprising the steps of:

heating said amorphous alloy to a temperature sufficient to relieve stress in said alloy but less than required to initiate crystallization in said alloy, the temperature being determined as a function of the desired magnetic remanence-to-saturation ratio in said alloy; and then cooling said alloy at a rate between approximately 0.1° C. per minute and approximately 100° C. per minute from said preadjusted temperature in the presence of a directed magnetic field.

9. The method of claim 8 wherein said alloy comprises a ribbon and said magnetic field is directed parallel to the length of said ribbon.

10. The method of claim 8 wherein said alloy comprises a ribbon and said magnetic field is directed in the plane of said ribbon and transverse to its length.

* * * * *

US004116728B1

REEXAMINATION CERTIFICATE (2284th)

United States Patent [19]

Becker et al.

[11] B1 4,116,728

[45] Certificate Issued May 3, 1994

[54] TREATMENT OF AMORPHOUS MAGNETIC ALLOYS TO PRODUCE A WIDE RANGE OF MAGNETIC PROPERTIES

[75] Inventors: Joseph J. Becker; Fred E. Luborsky; Israel S. Jacobs; Richard O. McCary, all of Schenectady, N.Y.

[73] Assignee: General Electric Company, Schenectady, N.Y.

Reexamination Request:
No. 90/002,931, Jan. 8, 1993

Reexamination Certificate for:

| | |
|---|---|
| Patent No.: | **4,116,728** |
| Issued: | **Sep. 26, 1978** |
| Appl. No.: | **719,914** |
| Filed: | **Sep. 2, 1976** |

[51] Int. Cl.[5] ..... C21D 1/04

[52] U.S. Cl. ..... 148/108; 148/121; 148/304; 336/213

[58] Field of Search ..... 148/108, 121, 561, 304; 336/213; 315/248

[56] References Cited

U.S. PATENT DOCUMENTS

| | | | |
|---|---|---|---|
| 2,965,525 | 12/1960 | Burbank et al. | 148/108 |
| 3,721,984 | 3/1973 | Codina | 324/43 R |
| 3,856,513 | 12/1974 | Chen et al. | 148/403 |
| 3,987,335 | 10/1976 | Anderson | 315/62 |
| 3,989,557 | 11/1976 | Henmi et al. | 148/120 |
| 4,003,768 | 1/1977 | Anderson et al. | 148/108 |
| 4,033,795 | 7/1977 | Berry et al. | 148/108 |
| 4,038,073 | 7/1977 | O'Handley et al. | 75/170 |
| 4,053,331 | 10/1977 | Graham, Jr. et al. | 148/120 |
| 4,053,333 | 10/1977 | Egami et al. | 148/120 |
| 4,056,411 | 7/1977 | Chen et al. | 148/121 |
| 4,081,298 | 3/1978 | Mendelsohn et al. | 148/121 |
| 4,126,287 | 11/1978 | Mendelsohn et al. | 245/8 |
| 4,144,058 | 3/1979 | Chen et al. | 75/170 |
| 4,152,144 | 5/1979 | Hasegawa et al. | 75/122 |

FOREIGN PATENT DOCUMENTS

| | | | |
|---|---|---|---|
| 45-25588 | 8/1970 | Japan | 148/108 |
| 490845 | 2/1976 | U.S.S.R. | 148/121 |

OTHER PUBLICATIONS

R. C. Sherwood, et al., "Ferromagnetic Behavior of Metallic Glasses", American Institute of Physics Conference Proceedings, No. 24, pp. 745–746, 1975.

H. Fujimori, et al., "On the Magnetically induced Anisotropy in Amorphous Ferromagnetic Alloys", presented at the 2nd Int'l Symposium, RPI, Aug. 25–27, 1976, Published 1977, *Amorphous Magnetism.*

H. Fujimori, et al., "New Co-Fe Amorphous Alloys as Soft Magnetic Materials", Published Science Reports of the Research Institute, Sendai, Japan A—vol. 26, No. 1, Jun. 1976.

H. Fujimori et al., "Magnetization Process of Ferromagnetic Amorphous Compound (Fe-P-C compound)", Metals, (Japan Inst. of Metal, Nov. 1974).

M. Takahashi et al., "The Variation of the Uniaxial Magnetic Anistrophy along the Thickness in an Amorphous $Fe_{80}P_{13}C_7$ Alloy", Japan Journal of Applied Physics, vol. 15, No. 9, 1976.

M. Takahashi et al., "Magnetic Anisotropy of an Amorphous $Fe_{80}P_{13}C_7$ Alloy", Japan Journal of Applied Physics, vol. 15, No. 1, 1976.

R. Hasegawa, "Magnetization, Anisotropy and Coercity of a Glassy Metallic Alloy", published 1976.

C. D. Graham, Jr., et al., "Annealing Effects in Amorphous Magnetic Alloys", AIP Conf. Proc., No. 29, p. 218, 1976.

T. Masumoto, et al., "Recent Developments of Research on Amorphous Metals", Science Report of RITU, vol. 25, 1975, p. 244.

J. J. Gilman, "Metallic Glasses", Physics Today, pp. 46–53, 1975.

T. Egami, et al., "Temperature Dependence of 'Magnetic Anistropy' in Amorphous Alloys", MMM Conf., 1975, published AIP Conf. Proc., No. 29, 1976.

T. Egami, et al., "Low-Field Magnetic Properties of Ferro-Magnetic amorphous Alloys", Applied Physics Letters, vol. 26, No. 3, pp. 128–130, 1975.

H. S. Chen, et al., "Field Heat Treatment of Ferromagnetic Metallic Glasses", Applied Physics Letters, vol. 26, No. 7, (Apr. 1975, pp. 405–406), 1966 ASTM Standards A34 and A341.

H. Fujimori, et al., "On the Magnetization Process in an

Iron-Phosphorous-Carbon Amorphous Ferromagnet", Short Notes, Japan Journal of Applied Physics, vol. 13, No. 11, (1974), pp. 1889-1890.

R. M. Bozorth, *Ferromagnetism*, (Van Nostrand, Princeton, N.J., 1951), pp. 3 to 5, 171 to 177, 635 to 639 and pp. 693 to 697.

T. Egami, et al., "Amorphous Alloys as Soft Magnetic Materials", AIP Conf. Proc., No. 24 (1975).

H. Pender and W. H. Del Mar, Electrical Engineers Handbook, (Electric Power), pp. 10-41 to 10-43, Fourth Edition, 1949.

F. Luborsky et al., "Magnetic Annealing of Amorphous Alloys", IEEE Transactions on Magnetics, Nov. 1975.

M. Kikuchi et al., "New Amorphous Ferromagnets with Low Coercive Force", *Jap. J. Appl. Phys.*, vol. 14, (1975), No. 7.

"Armco Oriented Electrical Steels", Armco Steel Corporation, (1974), pp. 1 to 18.

B. S. Berry et al., "Magnetic Annealing and Directional Ordering of an Amorphous Ferromagnetic Alloy", *Phys. Rev. Lett.*, vol. 34, No. 16, (Apr. 21, 1975), pp. 1022 to 1025.

R. M. Bozorth et al., "Heat Treatment of Magnetic Materials in a Magnetic Field, II. Experiments with Two Alloys", *Physics*, vol. 6, (Sep., 1935), pp. 285 to 291.

H. S. Chen et al., "Field Heat Treatment of Ferromagnetic Metallic Glasses", *Appl. Phys. Lett.*, vol. 26, No. 7, (Apr. 1, 1975), pp. 405 and 406.

C. D. Graham, Jr., "Magnetic Annealing", pp. 288 to 329 in *Magnetic Properties of Metals and Alloys*, (Amer. Soc. for Met., 1959).

*Primary Examiner*—George Wyszomierski

[57] ABSTRACT

Amorphous magnetic metal alloys are processed by annealing at temperatures sufficient to achieve stress relief and cooling in directed magnetic fields or in zero magnetic fields.

The ac and dc properties of magnetic core produced in accordance with the processes of the invention may be tailored to match those of a wide range of magnetic alloys.

Alloys processed in accordance with the invention provide improved performance in inductors, transformers, magnetometers, and electrodeless lamps.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-10 are cancelled.

New claims 11-17 are added and determined to be patentable.

*11. A method for processing magnetic amorphous alloys to control the shape of the hysteresis loop of said alloys, said method comprising the steps of:*

*heating an amorphous magnetic alloy to a temperature above its Curie temperature sufficient to achieve stress relief but less than that required to initiate crystallization; and then*

*controllably cooling said alloy through its Curie temperature and in the presence of a magnetic field to produce a dc remanence ratio Mr/Ms of approximately 0.9, the rate of cooling being between approximately 0.1° C. per minute and approximately 100° C. per minute whereby magnetic amorphous alloys are usable in a greater variety of magnetic circuit applications.*

*12. The method of claim 11 wherein said amorphous magnetic alloy is disposed as a ribbon and wherein said magnetic field is directed parallel to the length of said ribbon.*

*13. The method of claim 11 wherein said magnetic alloy comprises iron and materials selected from the group consisting of nickel, cobalt, and mixtures thereof.*

*14. The method of claim 13, wherein said amorphous alloy comprises a binary system of iron and nickel.*

*15. The method of claim 13 wherein said amorphous alloy comprises* $Fe_{40}Ni_{40}P_{14}B_6$.

*16. A method for adjusting the magnetic properties of a magnetic amorphous alloy comprising the steps of:*

*heating said amorphous alloy to a temperature above its Curie temperature sufficient to relieve stress in said alloy but less than required to initiate crystallization in said alloy, the temperature being determined as a function of the desired magnetic remanence-to-saturation ratio in said alloy; and then*

*cooling said alloy through its Curie temperature and at a rate between approximately 0.1° C. per minute and approximately 100° C. per minute from said preadjusted temperature in the presence of a directed magnetic field to produce a dc remanence ratio Mr/Ms of approximately 0.9.*

*17. The method of claim 16 wherein said alloy comprises a ribbon and said magnetic field is directed parallel to the length of said ribbon.*

* * * * *